US006923893B2

(12) United States Patent
Sano

(10) Patent No.: US 6,923,893 B2
(45) Date of Patent: Aug. 2, 2005

(54) LIQUID DISTRIBUTOR

(75) Inventor: Yoichi Sano, Zushi (JP)

(73) Assignee: First Ocean Co., Ltd., Yokohama (JP)

( * ) Notice: Subject to any disclaimer, the term of this patent is extended or adjusted under 35 U.S.C. 154(b) by 91 days.

(21) Appl. No.: 10/413,269

(22) Filed: Apr. 14, 2003

(65) Prior Publication Data

US 2003/0197075 A1 Oct. 23, 2003

(30) Foreign Application Priority Data

Apr. 18, 2002 (JP) ..... 2002-116460

(51) Int. Cl.[7] ..... B05B 7/08

(52) U.S. Cl. ..... 204/242; 239/549; 239/551; 239/566

(58) Field of Search ..... 239/549, 551, 239/566; 204/242

(56) References Cited

U.S. PATENT DOCUMENTS 1,642,154 A * 9/1927 Kemp ..... 239/566

1,945,298 A * 1/1934 Schmidt ..... 239/566

FOREIGN PATENT DOCUMENTS

JP 2000-246249 9/2000

* cited by examiner

*Primary Examiner*—Harry B. Tanner
(74) *Attorney, Agent, or Firm*—Flynn, Thiel, Boutell & Tanis, P.C.

(57) ABSTRACT

A distribution tube includes multiple liquid discharge openings provided in a sidewall of a tube body that has one liquid inlet, but is sealed off at its front end. The liquid distributor has a simple structure that allows manual adjustment of the amount of liquid discharged from the liquid discharge openings. In another embodiment, the tubular liquid distributor has a tube body with openings for liquid inlets at both ends and the center part is sealed. The sidewall of the tube body has multiple liquid discharge openings. Multiple entrance sealing rods that each have a conical tip are located on a sidewall opposite to the multiple liquid discharge openings and threaded into the tube body.

3 Claims, 5 Drawing Sheets

LIQUID DISTRIBUTOR

BACKGROUND OF THE INVENTION

1. Field of the Invention

The present invention relates to a liquid distributor used in order to supply liquid in distributed fashion.

2. Description of the Prior Art

The intake of liquid from a single inlet and the discharge thereof from multiple discharge openings is performed in many fields, and various means have been offered. A simple method that has been recently employed involves a branching tube that has one inlet, but is divided into multiple branches at the other end. In addition, methods have also been used that involve liquid distribution tubes with liquid discharge openings provided in the side wall of a tube that has one liquid inlet, but is sealed off at the other end.

BRIEF SUMMARY OF THE INVENTION

The present invention relates to a distribution tube in which multiple liquid discharge openings are provided in the sidewall of a tube body that has one liquid inlet, but is sealed off at its front end, and has the objective of offering a liquid distributor with an extremely simple structure, which allows manual adjustment of the amount of liquid discharged from the liquid discharge openings, and in particular, a liquid distributor that is suitable for use in water electrolysis devices of a specific structure.

Specifically, the present invention offers a tubular liquid distributor comprising; a tube body whose one end is an opening for liquid inlet and another end is sealed, wherein on the side wall of said tube body multiple liquid discharge openings are provided and on the opposite side to said multiple liquid discharge openings, multiple entrance sealing rods which have a conical tip being opposite to said multiple liquid discharge openings are threaded in.

BRIEF ILLUSTRATION OF DRAWINGS

Figure 1:
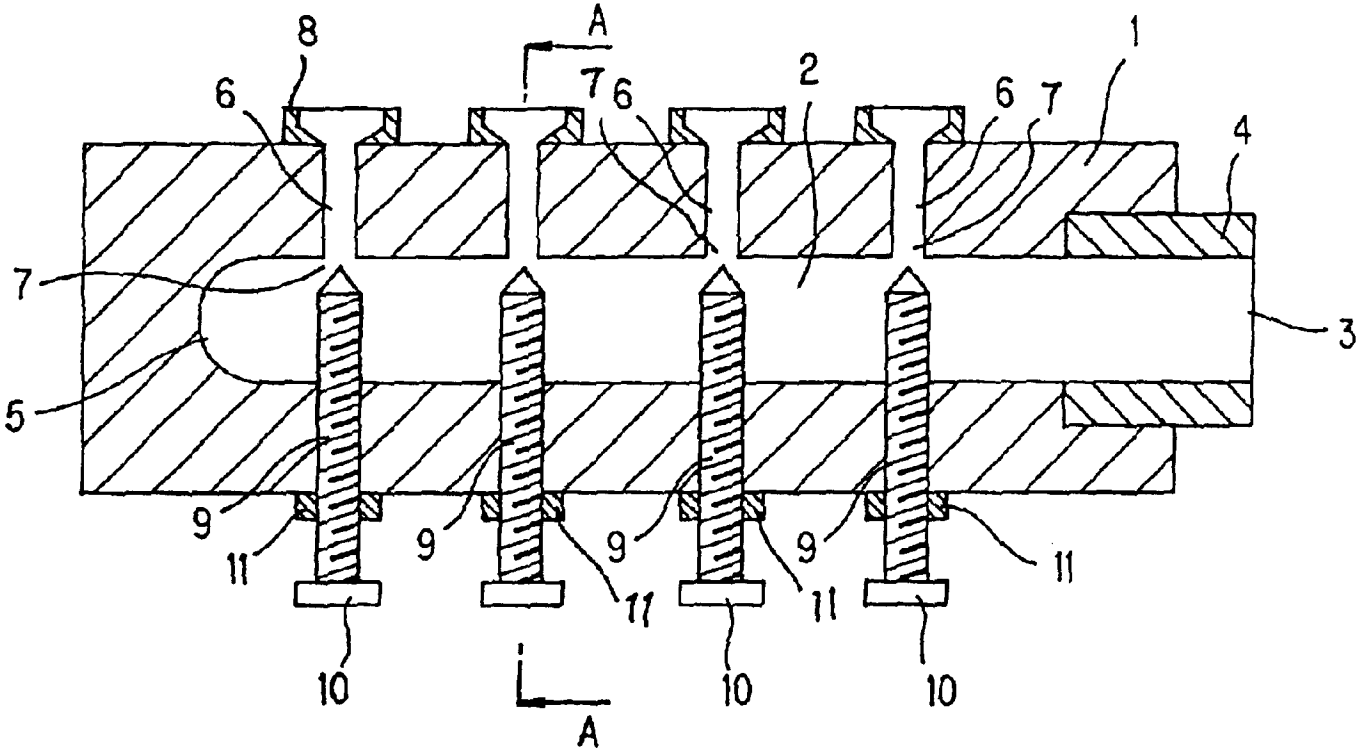
FIG. 1 is a cross-sectional view of an example of the liquid distributor of the present invention.

In the drawings, each numerical mark indicates as follows.

1: Tube
2, 12, 22: Water flow paths
3, 13, 23: Liquid inlets
4, 14, 24: Attachments
5, 15, 25: Sealed parts
6: Liquid discharge opening
7: Liquid discharge opening entrance
8: Liquid outlet
9: Entrance sealing rod
10: Thumb screw
Support member

DETAILED DESCRIPTION OF THE INVENTION

Figure 2:
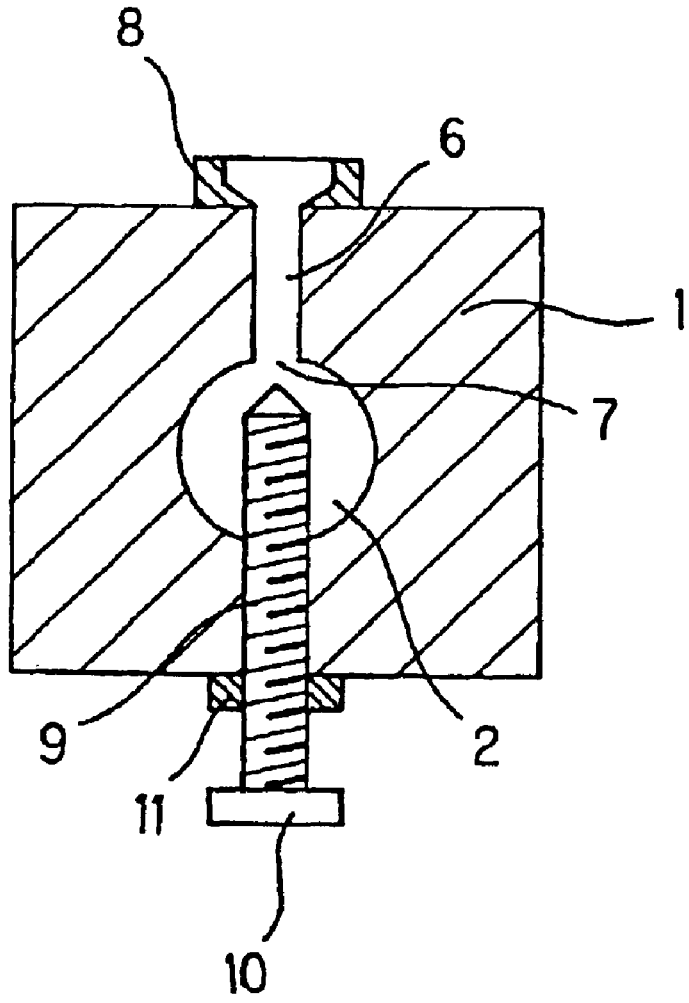
FIG. 2 is a cross-sectional view of FIG. 1 along the line A—A.

FIG. 1 is a cross-sectional diagram of the liquid distributor of the present invention, and FIG. 2 is a cross-sectional diagram of FIG. 1 along the line A—A. In FIGS. 1 and 2, 1 denotes a tube with a square cross section, having a water flowpath 2 with a circular cross section. The liquid inlet 3 of the tube 1 leads to the flowpath 2, and the flowpath 2 is sealed off at the opposite side 5. 4 is an attachment that is provided in order to facilitate attachment of a metal tube or plastic tube to the liquid inlet 3. Liquid discharge openings 6 are provided on the side wall of the water flowpath 2 of the tube 1. In the example presented in FIG. 1, four liquid discharge openings 6 are made in arrow. 7 denotes the entrance of a liquid discharge opening 6, and 8 denotes a liquid outlet situated at the exit of the liquid discharge opening 6. A metal tube or plastic tube is attached to this liquid outlet 8 and can be connected to the desired liquid supply port. The liquid outlet 8 is attached to the tube body 1 by means of attachment or threading.

9 denotes rods for sealing off the entrances 7 of the liquid discharge openings 6, or specifically, liquid discharge entrance sealing rods. The tips of the rods narrow so that the shape of the cone tips matches the shape of the entrances 7 of the liquid discharge openings 6. However, because the entrances 7 are generally circular, the tips are circular, in most cases. The entrance sealing rods 9 are threaded into openings formed in the wall on the side opposite from the liquid discharge openings 6, so a rod is opposite each of the liquid discharge openings. 11 denotes a support member for the entrance sealing rods 9. The entrance sealing rods 9 can be threaded into the support member 11. 10 denotes thumb screws provided at the ends of the entrance sealing rods 9 The liquid distributor of the present invention is manufactured using members made from synthetic resin.

An example of the method for using the liquid distributor of the present invention is presented below. First, a plastic tube is attached to the attachment 4 of the tube 1, and the tube is hooked up to a water hose. Each of the four liquid outlets 8 is then hooked up to the prescribed supply openings for other devices or equipment using plastic lines, and the water hose valve is opened so that tap water enters into the water flowpath 2 from the liquid inlet 3. The tap water entering into the water flowpath 2 enters each of the entrances 7, passes through the liquid discharge openings 6, and is discharged from the liquid outlets 8, thereby being supplied to the prescribed supply ports on other devices or equipment. Specifically, the tap water is distributed to four locations.

At this time, if the entrance sealing rods 9 are separated from the entrances 7 of the liquid discharge openings 6, the tap water in the water flowpath 2 will flow into the liquid discharge openings 6 unimpeded, and will be discharged from the liquid outlets 8 at maximum flow. Next, when the thumbscrew 10 of an entrance sealing rod 9 is then turned and threaded by hand so that the conical part at the tip of the entrance sealing rod 9 advances towards the entrance 7 of the liquid discharge opening 6, the entrance 7 of the liquid discharge opening 6 will be closed off by the entrance sealing rod 9. As a result, the water flow discharged from the liquid outlet 8 will gradually diminish. Eventually, the conical part at the tip of the entrance sealing rod 9 will insert into the liquid discharge opening 6, thereby completely closing off the entrance 7, so that no tap water enters the entrance 7, and no water is discharged from the liquid discharge opening 8.

With the liquid distributor of the present invention in which the distribution means and liquid flow adjustment means are integrated, entrance sealing rods 9 are provided respectively opposite each of the liquid discharge openings 6. It is thus possible to continuously increase or decrease each of the liquid flows entering from the entrances 7 of the four liquid discharge openings 6. As a result, the liquid flow amounts for the four liquid outlets 8 can each be separately adjusted. By using the liquid distributor of the present invention, liquid is distributed to multiple locations and discharged, thus making it possible to supply liquid from each of the discharge openings to other devices or equipment at different flow amounts.

Figure 3:
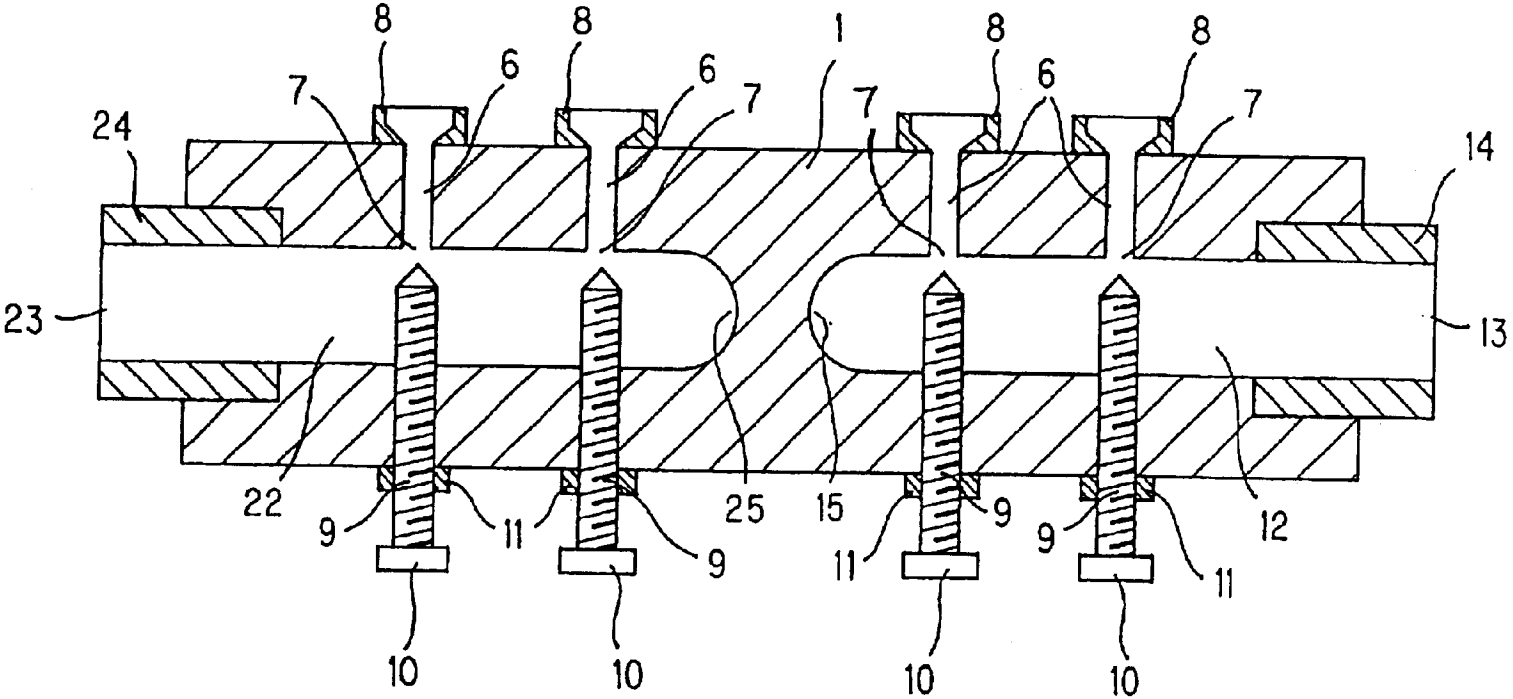
FIG. 3 is a cross-sectional view of another example of the liquid distributor of the present invention.

In the liquid distributor shown in FIG. 1, the liquid entering from the inlet is partitioned into four streams by being discharged from four liquid discharge openings 8. Consequently, there are cases where the discharge flow from the liquid discharge openings 8 is insufficient. When this type of problem occurs, the problem can be solved by means of using the liquid distributor of FIG. 3. FIG. 3 is another cross-sectional diagram of the liquid distributor of the present invention. As in FIG. 1, the device is a liquid distributor whereby tap water is discharged from four liquid discharge openings 8, however, liquid inlets are present at both ends of the tube 1. Specifically, a mode is adopted wherein two tubes are joined opposite each other so that liquid entering from one of the liquid inlets is discharged through two liquid discharge openings 8.

In FIG. 3, the liquid inlet 13 of the tube 1 leads to the water flowpath 12, and the water flowpath 12 is closed off at the other end 15. In addition, the liquid inlet 23 of tube 1 leads to the water flowpath 22, and the water flowpath 22 is closed off at the opposite end 25. Numbers 6 to 10 employ the same definitions as in FIG. 1. The action of the opposite entrance sealing rods 9 that seal off the entrances 7 of the liquid discharge openings 6 is also the same as descried in FIG. 1. When the liquid distributor of FIG. 3 is used, it is possible to increase the flow of discharged water from the liquid discharge openings 8.

Figure 4:
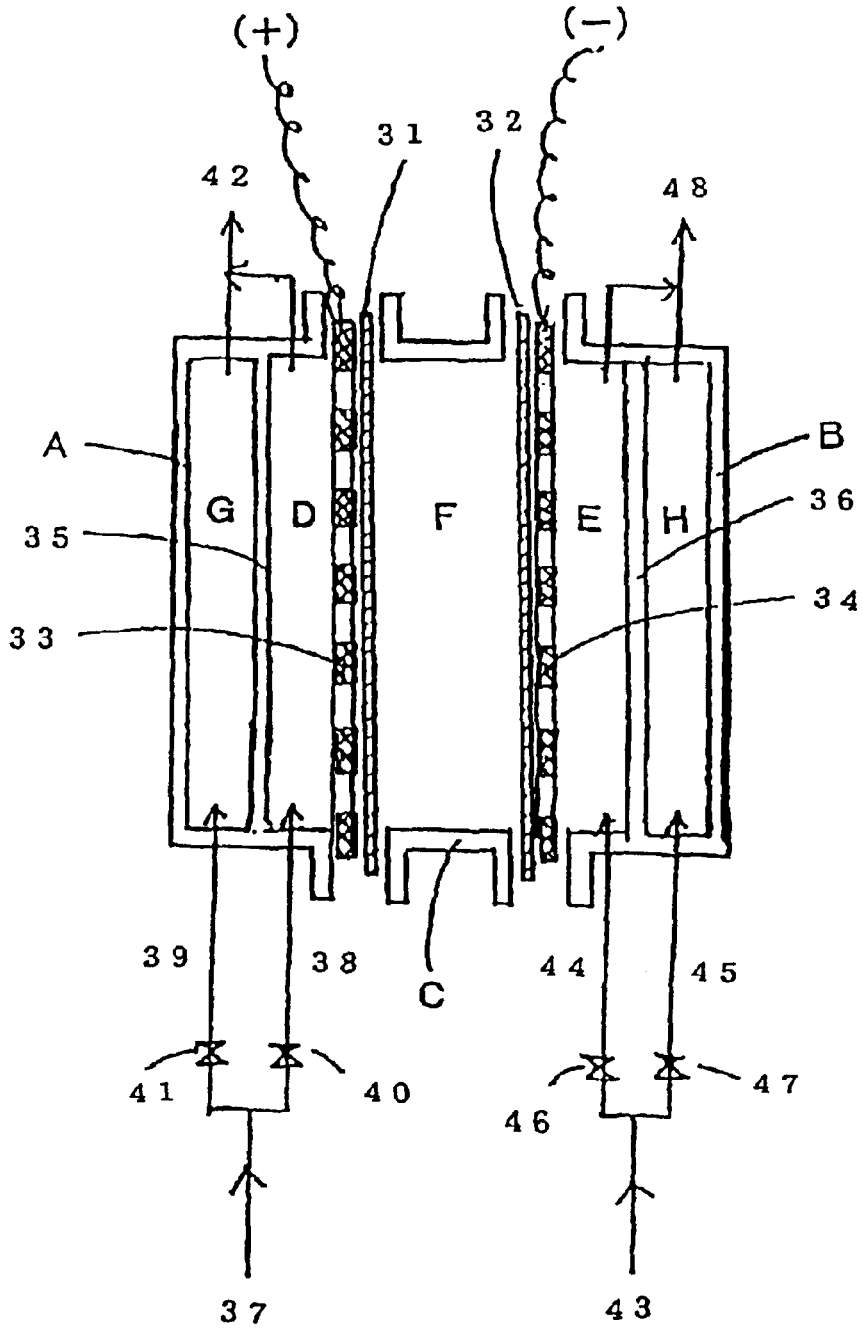
FIG. 4 is a water electrolysis device employing the liquid distributor of the present invention.
Figure 5:
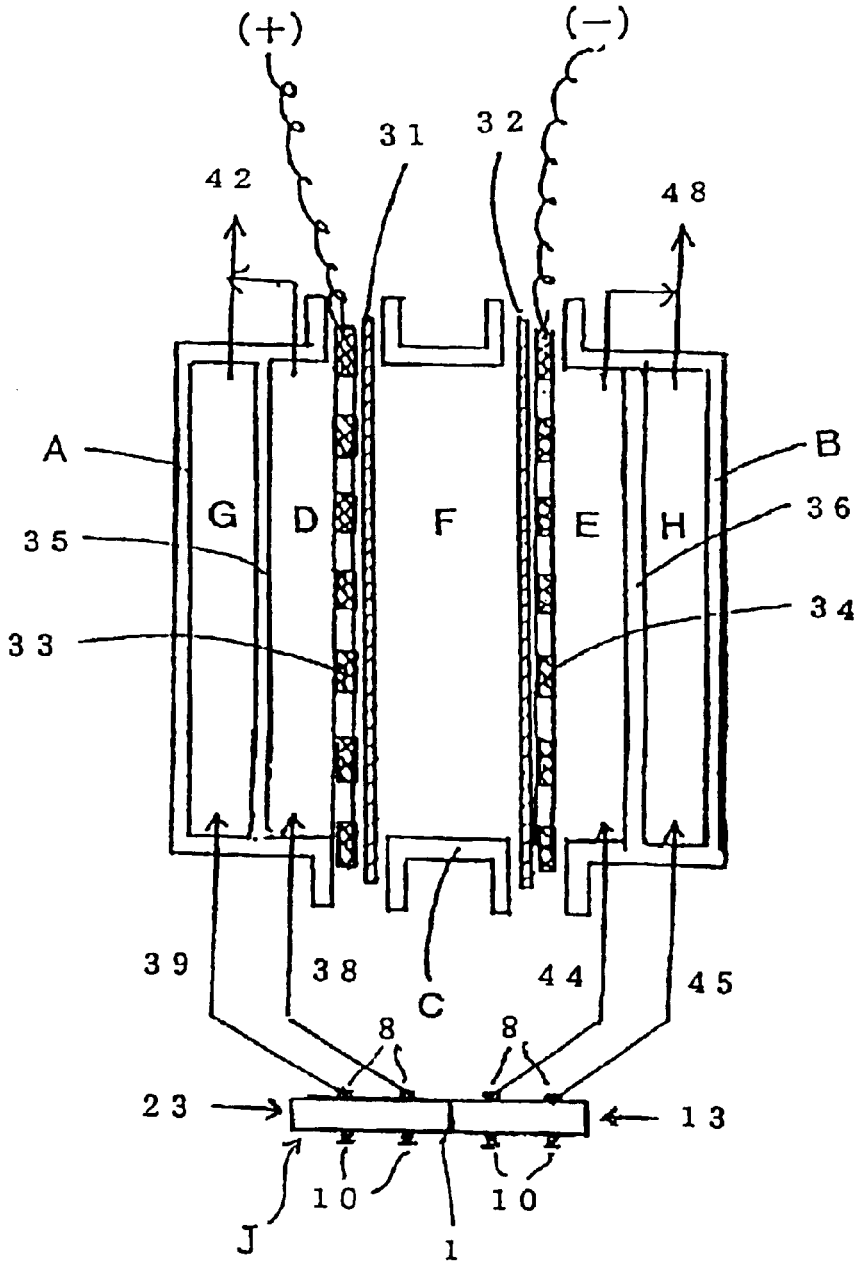
FIG. 5 is a water electrolysis device employing the liquid distributor of the present invention.

Examples in which the liquid distributor of the present invention is employed in an water electrolysis device are presented in FIG. 4 and FIG. 5. FIG. 4 presents a conventional water electrolysis device. A, B and C are walls of respective electrolysis chambers. The electrolysis chamber is divided by separating plates 35 and 36, and barrier membranes 31 and 32 into a water flowpath G, positive electrode chamber D, middle chamber F for storing electrolyte aqueous solution, negative electrode chamber E and water flowpath H, moving from left to right. 33 denotes a positive electrode plate, and 34 denotes a negative electrode plate. The water flowpath G is bounded by the side wall A of the electrolysis chamber and the partition plate 35, whereas the water flowpath H is bounded by the side wall B of the electrolysis chamber and the partitioning plate 36. The water that passes through the water flowpaths G and H has a cooling action on the electrolysis chamber.

The water electrolysis device of FIG. 4 operates in the following manner. Specifically, the source water 37 on the positive electrode side is partitioned by the branching tubes into water to be electrolyzed 38 and non-electrolyzed water 39. The water to be electrolyzed 38 flows through the positive electrode chamber D, and the non-electrolyzed water 39 flows through the water flowpath G. The water that has flowed through the positive electrode chamber D and has been electrolyzed is then mixed through confluence with the non-electrolyzed water 39, thus forming acidic electrolyzed water 42 with a prescribed pH of 2.0–5.0. In performing pH adjustment, it is important to adjust the water supply amounts of water to be electrolyzed 38 and the non-electrolyzed water 39. Thus, adjustment of water supply amounts is carried out by valves 40 and 41 provided on each of the tubes.

On the other hand, the source water 43 on the negative electrode side flows through the divided tube along with the water to be electrolyzed 44 and non-electrolyzed water 45 in a partitioned flow. The water to be electrolyzed 44 then flows through the negative electrode chamber E, and the non-electrolyzed water 45 flows through the water flowpath H. Subsequently, the electrolyzed water 44 that flows through the negative electrode chamber E is mixed by confluence with the non-electrolyzed water 45 subsequent to the electrolysis treatment, thus producing alkali electrolyzed water 48 with a pH of 9.0–13.0. In adjusting pH, the amount of water supplied from the non-electrolyzed water 45 and the electrolyzed water 44 is critical, and adjustment of the supplied water amount is carried out using valves 46 and 47 provided on each tube.

FIG. 5 is a schematic diagram showing the use of the liquid distribution device of the present invention in the conventional water electrolysis device of FIG. 4. In FIG. 5, J is the liquid distributor shown in FIG. 3. 1 denotes a tube, 13 and 23 denote liquid inlets, 8 denotes liquid outlets, and 10 denotes thumb screws. The source water entering tube 1 from the liquid inlet 23 is distributed to 38 and 39, and then enters into the water electrolysis device from the liquid discharge openings 8. In addition, the source water entering into the tube 1 from the liquid inlet 13 is distributed to 44 and 45, and then enters into the water electrolysis device from the respective liquid discharge openings 8. Adjustment of the water flows from 38 and 39 for pH adjustment, etc., is carried out using the respective thumb screws 10. Similarly, adjustment of the water flows from 44 and 45 is similarly carried out using respective thumb screws 10. In the conventional example presented in FIG. 4, the tube flowpath that supplies water to the water electrolysis device necessarily incorporates two branched tubes and four valves, and thus also requires room in which to form these members. However, when the liquid distributor of the present invention is used, water supply flowpaths can be readily combined without using very much space. Moreover, adjustment of supply water flow can be carried out with thumb screws, allowing fine control of supply water flows, and facilitating production of electrolyzed water of a prescribed pH.

EFFECT OF THE INVENTION

The liquid distributor of the present invention has the advantage of an extremely simple structure wherein the distribution means and discharge flow adjustment means are integrated together, while also allowing manual adjustment of liquid flow from each of the liquid discharge openings. The liquid distribution device of the present invention is particularly well suited to use in water hydrolysis devices having specific structures.

What is claimed is:

1. A tubular liquid distributor comprising: a tube body having liquid inlets at both ends and a center part of the tube body is sealed, wherein on a side wall of said tube body, multiple liquid discharge openings are provided and on an opposite side wall to said multiple liquid discharge openings, multiple entrance sealing rods are threaded therein, that each have a conical tip facing the respective one of said multiple liquid discharge openings.

2. A tubular liquid distributor for a water electrolysis apparatus comprising a middle chamber for storing electrolyte aqueous solution located at a center, a first flowpath and a positive electrode chamber located at one side of said middle chamber, and a negative electrode chamber and a second water flowpath located at another side of said middle chamber, said liquid distributor to be applied to the apparatus for the electrolysis of water such that electrolyzed water flowing from the positive electrode chamber is joined with water from the first flowpath and electrolyzed water flowing from the negative electrode chamber is joined with water of the second flowpath, wherein said tubular liquid distributor comprises a tube body having at one end an opening for a liquid inlet and sealed at the other end, and on a side wall of said tube body four liquid discharge openings are provided and on an opposite side to said four liquid discharge openings, four entrance sealing rods which each have a conical tip and being opposite to said four liquid discharge openings are threaded in, wherein the first flowpath, the positive electrode chamber, the negative electrode chamber and the second water flowpath are respectively connected with said four liquid discharge openings of the tubular liquid distributor through respective tubes.

3. A tubular liquid distributor for use with a water electrolysis device comprising a middle chamber for storing electrolyte aqueous solution located at a center, a first flowpath and a positive electrode chamber located at one side of the middle chamber, and a negative electrode chamber and second water flowpath located at another side of said middle chamber, said tubular liquid distributor comprising:

a tube body having openings at both ends for liquid inlets and a center part of the tube body is sealed, and on one side wall of said tube body liquid discharge openings are provided, and on an opposite side wall to said liquid discharge openings, corresponding entrance sealing rods that each have a conical tip and are aligned opposite to said corresponding liquid discharge openings are provided, wherein the first flowpath, the positive electrode chamber, the negative electrode chamber and the second water flowpath are respectively connected with said liquid discharge openings of the tubular liquid distributor through respective tubes, wherein said liquid distributor is capable of being applied to the device for the electrolysis of water such that electrolyzed water flowing from the positive electrode chamber is joined with water from the first flowpath and electrolyzed water flowing from the negative electrode chamber is joined with water from the second flowpath.

* * * * *